US010440494B2

(12) United States Patent
Ghorbal et al.

(10) Patent No.: US 10,440,494 B2
(45) Date of Patent: Oct. 8, 2019

(54) METHOD AND SYSTEM FOR DEVELOPING A HEAD-RELATED TRANSFER FUNCTION ADAPTED TO AN INDIVIDUAL

(71) Applicant: Mimi Hearing Technologies GmbH, Berlin (DE)

(72) Inventors: Slim Ghorbal, Rennes (FR); Renaud Seguier, Acigne (FR); Xavier Bonjour, Le Port Marly (FR)

(73) Assignee: Mimi Hearing Technologies GmbH (DE)

( * ) Notice: Subject to any disclaimer, the term of this patent is extended or adjusted under 35 U.S.C. 154(b) by 0 days.

(21) Appl. No.: 15/755,502

(22) PCT Filed: Jul. 5, 2016

(86) PCT No.: PCT/EP2016/065839
§ 371 (c)(1),
(2) Date: Feb. 26, 2018

(87) PCT Pub. No.: WO2017/041922
PCT Pub. Date: Mar. 16, 2017

(65) Prior Publication Data

US 2018/0249275 A1 Aug. 30, 2018

(30) Foreign Application Priority Data

Sep. 7, 2015 (FR) ..... 15 58279

(51) Int. Cl.
*H04S 7/00* (2006.01)

(52) U.S. Cl.
CPC ..... *H04S 7/303* (2013.01); *H04S 7/301* (2013.01); *H04S 7/307* (2013.01); *H04S 2420/01* (2013.01)

(58) Field of Classification Search
CPC . H04S 7/303; H04S 7/30; H04S 7/307; H04S 2420/01; H04S 7/302
(Continued)

(56) References Cited

U.S. PATENT DOCUMENTS 6,996,244 B1 * 2/2006 Slaney ..... H04S 1/002 381/303
7,209,564 B2 4/2007 Jin et al.
(Continued)

FOREIGN PATENT DOCUMENTS

WO 2011/128583 A1 10/2011

OTHER PUBLICATIONS

S. Rodriguez et al., "HRTF Individualization by Solving the Least Square Problem," 118th AES Convention, May 28, 2005-May 31, 2005, XP040372767.
(Continued)

*Primary Examiner* — Disler Paul
(74) *Attorney, Agent, or Firm* — Polsinelli PC

(57) ABSTRACT

A method for generating an individual-specific head-related transfer function from a database containing 3D or 2D ear data and corresponding head-related transfer functions, the method comprises the steps of: performing a statistical analysis of the 3D or 2D ear space of the database; performing a statistical analysis of the head-related-transfer-function space of the data base; performing an analysis of the relationships between the statistical parameters of the statistical analysis of the 3D or 2D ear space and the statistical parameters of the head-related-transfer-function space; and determining, from the relationship analysis and the statistical analysis of the 3D or 2D ear space, a function for calculating a head-related transfer function from data representative of at least one ear.

9 Claims, 4 Drawing Sheets

(58) Field of Classification Search
USPC ..... 381/60, 303
See application file for complete search history.

(56) References Cited

U.S. PATENT DOCUMENTS

2006/0067548 A1 3/2006 Slaney et al.
2015/0312694 A1* 10/2015 Bilinski ..... H04S 7/302 381/1

OTHER PUBLICATIONS

A. Meshram et al., "P-HRTF: Efficient personalized HRTF computation for high-fidelity spatial sound," 2014 IEEE International Symposium on Mixed and Augmented Reality, Sep. 10, 2014, pp. 53-61, XP032676177.
E. Torres-Gallegos et al., "Personalized of head-related transfer functions (HRTF) based on automatic photo-anthropometry and inference from a database," Applied Acoustics, vol. 97, Apr. 7, 2015, pp. 84-95, XP029221944.
P. Guillon et al., "Head-Related Transfer Function Customization by Frequency Scaling and Rotation Shift Based on a New Morphological Matching Method," AES Convention 125; Oct. 1, 2008, XP040508788.
D. Zotkin et al., "HRTF personalization using anthropometric measurements," 2003 IEEE Workshop on Applications of Signal Processing to Audio and Acoustics, Oct. 19, 2003, pp. 157-160, XP010697926.
S. Busson et al., "Individualisation d'Indices Acoustiques pour la Synthèse Binaurale," [Customization of Acoustic Indices for Binaural Sythesis]; PhD thesis, Université de la Méditerranée-Aix-Marseille II, 2006.
Song Xu et al., "Improved method to individualize head-related transfer function using anthropometric measurements," Acoustical Science and Technology, vol. 29, No. 6, pp. 388-390, 2008.
R. A. Kennedy et al., "Statistical method to identify key anthropometric parameters in HRTF individualization," In Joint Workshop on Hands-free Speech Communication and Microphone Arrays, 2011.
P. Hofman et al., "Reconstruction of sound localization cues from responses to random spectra," Biological cybernetics, vol. 86, No. 4, pp. 305-316, 2002.
R. Tame et al., "Headphone virtualization: Improved localization and extemalization of nonindividualized HRTFs by cluster analysis," Audio Engineering Society Convention 133; Audio Engineering Society, May 2012.
Y. Iwaya, "Individualization of head-related transfer functions with tournament-style listening test: Listening with other's ears," Acoustical science and technology, vol. 27, No. 6, pp. 340-343, 2006.
B. Seeber et al., "Subjective selection of non-individual head-related transfer functions," Proceedings of the 2003 International Conference on Auditory Display, Jul. 2003.
W. Martens, "Rapid psychophysical calibration using bisection scaling for individualized control of source elevation in auditory display," Proc. Int. Conf. on Auditory Display, pp. 199-206, Jul. 2002.
J. Middlebrooks, "Virtual localization improved by scaling nonindividualized external-ear transfer functions in frequency," The Journal of the Acoustical Society of America, vol. 106, No. 3, pp. 1493-1510, 1999.

* cited by examiner

METHOD AND SYSTEM FOR DEVELOPING A HEAD-RELATED TRANSFER FUNCTION ADAPTED TO AN INDIVIDUAL

CROSS-REFERENCE TO RELATED APPLICATIONS

This application is a National Stage of International patent application PCT/EP2016/065839, filed on Jul. 5, 2016, which claims priority to foreign France patent application No. FR 1558279, filed on Sep. 7, 2015, the disclosures of which are incorporated by reference in their entirety.

FIELD OF THE INVENTION

The invention relates to a method and system for generating an individual-specific head-related transfer function.

The present invention pertains to the personalization of methods for generating 3D audio effects, also referred to as binaural sound. More particularly, it is a question of a method for customizing head-related transfer functions (HRTFs), key elements of any individual's spatial hearing.

BACKGROUND

Binaural hearing is a field of research that aims to understand the mechanisms allowing human beings to perceive the spatial origin of sounds. Based on the postulate that the morphology of an individual is what allows him to determine the spatial origin of sounds, it is in particular recognized in this field that elements of paramount importance are the position and shape of the ears of an individual. Specifically, the ears act as directional frequency filters on sounds that reach them.

Although the relationships between morphology and audition have been studied for a very long time, over the last twenty-five years a growing interest has been observed among the scientific community in the problem of customization, i.e. of how to take into account individual-specific attributes.

In particular, attention has been given to the customization of HRTFs, mathematical representations of the frequency coloration of the sounds that we perceive. The expression "frequency coloration" is understood to mean variations in audio-signal power spectral density. The spectra of white, pink or even gray noise are examples thereof. Many methods are now known, which may be classified into two broad families: synthetic methods, which aim to calculate or recreate sets of HRTFs; and adaptive methods, which aim to discover, from a given set of HRTFs, possibly at the cost of minor transformations, the transfer function most suited to an individual.

Among synthetic methods, mention may first be made of the exact calculations of probabilistic and statistical approaches.

Developed over more than twenty years, the family of finite-element methods aims to model then solve the problem, expressed in the form of partial derivatives, of propagation of sound from its source to the eardrum of the subject. This family in particular contains the following methods: the direct boundary element method (DBEM); the indirect boundary element method (IBEM); the infinite/finite element method (IFEM); and the fast-multipole boundary element method (FM-BEM).

Reputed to offer exact solutions to the addressed problem, these methods nevertheless have several notable drawbacks. Firstly, a 3D mesh of the subject must be generated.

Although this is not a problem per se, the higher the frequencies at which it is desired to calculate the HRTFs the finer the mesh must be, and as the fineness of the mesh increases (i.e. as the reliability desired for the high-frequency results increases) calculation time also increases and rapidly becomes prohibitive. The expression "high frequencies" is understood to mean frequencies above 4 kHz. Lastly, to physically model the problem requires, a priori, many approximations to be made. Thus, each surface is attributed a specific impedance (quantifying absorption/reflection effects) the value of which is empirical. Likewise, hair is conventionally modelled by a surface of different impendence to the skin, this model obviously not taking into account the bulky nature of hair.

An alternative approach to direct calculation of HRTFs consists in determining the main modes of variation from a representative set of real HRTFs.

This is in particular what Sylvain Busson did in his work ("*Individualisation d'Indices Acoustiques pour la Synthèse Binaurale*" [Customization of Acoustic Indices for Binaural Sythesis]; PhD thesis, Université de la Méditerranée-Aix-Marseille II, 2006) on artificial neural networks (ANNs). The idea studied in this thesis was that of predicting HRTFs on the basis of measurement of a limited number thereof. This was in particular done by conjoint implementation of a self-organizing map and an ascending hierarchical classification (AHC), before election of representative HRTFs. Subsequently, a three-layer multi-layer perceptron (MLP) neural network was constructed and the representative HRTFs of 44 subjects from the CIPIC database used by way of learning set. Although promising, this work neither found any universal representants, i.e. representants common to all individuals, nor presented a psycho-acoustic validation of the results. In addition, it is also necessary to make provision for a way of accessing said representants.

Statistical methods for synthesizing HRTFs may, as a variant, be based on principal components analysis (PCA).

Kistler and Wightman ("A model of head-related transfer functions based on principal components analysis and minimum-phase reconstruction"; The Journal of the Acoustical Society of America, 91(3):1637-1647, 1992) were the first to suggest decomposing HRTFs using this method. The set of HRTFs is then considered a vectorial subspace of the measurement space. Knowledge of a basis of this subspace then allows any representant thereof, i.e. any HRTF, to be determined via simple linear combination of basis vectors. This is what PCA makes possible by delivering an orthonormal basis of the space generated by the learning HRTFs. The last step of the solution of the customization problem then consists in finding the relationship between the morphological parameters of individuals and the reconstruction coefficients, with the eigenvectors of the basis. To do this, multiple linear regressions are conventionally used.

On the basis of the work of Kistler & Wightman, Xu et al. (Song Xu, Zhizhong Li, and Gavriel Salvendy: "Improved method to individualize head-related transfer function using anthropometric measurements"; Acoustical Science and Technology, 29(6):388-390, 2008) suggested grouping the HRTFs of the various measured individuals depending on specified direction (azimuth, elevation) before performing the PCA (one per group), with the aim of thus reducing estimation errors.

Zhang et al. (R. A. Kennedy M. Zhang and T. D. Abhayapala; "Statistical method to identify key anthropometric parameters in hrtf individualization"; In Joint Workshop on Hands-free Speech Communication and Microphone Arrays, 2011) for their part suggested a statistical method for estimating the most relevant anthropometric parameters for implementation of the regression step.

In 2007, Vast Audio Pty Ltd filed a patent (G. Jin, P. Leong, J. Leung, S. Carlile, and A. Van Schaik; "Generation of customized three dimensional sound effects for individuals", Apr. 24, 2007, U.S. Pat. No. 7,209,564) inspired by these ideas. In fact, the latter first describes the creation of a HRTF database and of a database of morphological parameters. Next, mention is made of use of a method of statistical analysis to decompose the HRTF and parameter spaces into elementary components, in the manner made possible by PCA. Subsequently, using another method of statistical analysis, relationships between the reconstruction coefficients of the morphological parameters and those of the HRTFs are determined.

Each method proposed up to now has generally allowed the results of prior methods to be improved without however generating an outcome that is completely satisfactory from the psycho-acoustic point of view i.e. under real conditions. In particular, the number and location of the required morphological parameters are very imprecise. In addition, in the case of simultaneous analysis of morphology and HRTFs, discovery of the relationships between the coefficients of the two spaces is all the more complex if the data are left in raw form.

Another type of synthetic method notable for its innovative character is the reconstruction of HRTFs using an Bayesian approach. It was suggested by Hofman & Van Opstal (Paul M Hofman and A John Van Opstal. Bayesian; "reconstruction of sound localization cues from responses to random spectra", Biological cybernetics, 86(4):305-316, 2002), who wanted to recreate potential HRTFs on the basis of a probabilistic analysis of the responses of studied subjects to very precise stimuli. More particularly, the idea was to make subjects listen to sounds convolved with filters mimicking the types of variations observable in actual HRTFs, the sounds being emitted by a loudspeaker located directly in front of the subjects. The subjects were asked to look with their eyes in the direction from which the sound seemed to be coming.

Although innovative, this method however has many drawbacks that do not work in its favor, such as the time required to perform the experiment or the inability to study HRTFs for sounds corresponding to positions outside of the subject's field of gaze, the subject being required to indicate with his eyes the directions from which the sounds seem to be coming.

Whereas the aforementioned synthetic methods aim to create new sets of HRTFs from scratch (without however ever having observed real examples thereof, contrary to finite-element methods) adaptive methods in contrast aim to model actual examples as closely as possible. The underlying idea consists in performing measurements on actual subjects in order to obtain sets of HRTFs that are valid for at least one person. They therefore necessarily contain a sufficient number of localization indices to be usable, something that synthetic methods cannot guarantee.

Selective methods make no alterations to the measurements; the principle in common is election of a set of HRTFs from a plurality according to certain criteria. The latter are most often psycho-acoustic, without however being limited thereto.

With respect to psycho-acoustic criteria, mention will first be made of the work by Shimada et al. (Shoji Shimada, Nobuo Hayashi, et Shinji Hayashi; "A clustering method for sound localization transfer functions", Journal of the Audio Engineering Society, 42(7/8):577-584, 1994). Starting with a substantial database of HRTFs, said authors grouped similar HRTFs together. To do this, a 16-coefficient cepstral decomposition was performed. The Euclidian distance naturally associated with this 16-dimensional space then allowed the HRTFs to be grouped into clusters (of 8 in number). Sets of HRTFs were then randomly chosen within the clusters and subjects invited to choose the one or more clusters that gave them the best impression of externality and directivity.

The reader may also refer to the more recent work by Tame et al. (Robert P Tame, Daniele Barchiese, and Anssi Klapuri; "Headphone virtualization: Improved localization and externalization of nonindividualized hrtfs by cluster analysis", in Audio Engineering Society Convention 133; Audio Engineering Society, May 2012) or even the work by Xie et al. (Bosun Xie and Zhaojun Tian; "Improving binaural reproduction of 5.1 channel surround sound using individualized hrtf cluster in the wavelet domain", in Audio Engineering Society Conference: 55th International Conference: Spatial Audio, Audio Engineering Society, August 2014) who respectively used Gaussians and a wavelet decomposition to group the HRTFs.

Once the cluster has been selected, another selecting step in which a very precise set is selected may be added. Once again, multiple methods have been published. For example, Y. Iwaya (Yukio Iwaya, "Individualization of head-related transfer functions with tournament-style listening test: Listening with other's ears", Acoustical science and technology, 27(6): 340-343, 2006) describes a procedure for selecting a set of HRTFs from 32 available HRTFs, this procedure applying a tournament-type principle. An audio path in a horizontal plane is simulated by convolving a pink noise with the sets of HRTFs. A pink noise is a noise the audio power of which is constant for a given frequency bandwidth in a logarithmic space (e.g. the same power is emitted in the 40-60 Hz band as in the 4000-6000 Hz band). 32 paths were therefore obtained and placed in competition. In each bout, the subject declared one of two paths to be victorious, this path being the one that most closely resembled the right path. The set that won the tournament was declared to be the best one for the subject.

Seeber et al. (Bernhard U Seeber and Hugo Fastl; "Subjective selection of non-individual head-related transfer functions", July 2003) present another approach to selecting, in two steps, one set among 12. The stated objective is for the selection to be fast, to require no prior training and to deliver a result minimizing the number of inside-the-head localizations. The first step consists in extracting the 5 sets providing the best results in terms of spatial perception in the frontal area. The second step consists in eliminating 4 depending on how well various behaviors (such as movement of an audio source at constant speed, at constant elevation or even at constant distance) are reproduced. About ten minutes is required to carry out the procedure.

Lastly, mention is also made of the approach of Martens (William L Martens; "Rapid psychophysical calibration using bisection scaling for individualized control of source elevation in auditory display"; in Proc. Int. Conf. on Auditory Display, pages 199-206, July 2002) which is referred to as bisection scaling. The idea is to create, using a psycho-acoustic test, a look-up table containing the correspondence between the actual directions associated with a set of HRTFs and the directions perceived by the subject. In practice, for a given azimuth, it is necessary to the find the HRTF that best corresponds to the sensation of an elevation of 45°. The elevation extrema (0° and 90°) being assumed to be perceived correctly, a second-order polynomial interpolation is then performed to construct the aforementioned table.

Yet other protocols have been proposed by the scientific community but none allow the drawbacks inherent to this type of methodology to be avoided. Specifically, even if the objective is not to find the exact HRTFs of the subject (it would be necessary to implement a synthetic method) but to select or adapt as best as possible an existing set, the quality of the best possible solution nevertheless remains limited by the variability in the sets of HRTFs open to selection. Thus, with a given protocol, the results obtained improve as the size of the database of input data increases. However, increasing the size of the database of input data increases the length of the required experimentation, this being undesirable, in particular as active subject participation is required.

Placing emphasis on the importance of the specific morphology of each individual, Zotkin et al. (D. N. Zotkin, J. Hwang, R. Duraiswaini, and L. S. Davis; "Hrtf personalization using anthropometric measurements", in Applications of Signal Processing to Audio and Acoustics, 2003 IEEE Workshop on, pages 157-160, October 2003) describe the ear by way of seven morphological parameters that are measurable in a profile image of the ear. These parameters allow an inter-individual distance to be defined, which is used to select, in the CIPIC database, the nearest neighbor of a given subject. It will be noted that the HRTFs thus selected are then modified for frequencies lower than 3 kHz. Specifically, at low frequencies (f≤500 Hz), a head-and-torso (HAT) model is used to synthesize the HRTFs. Between 500 Hz and 3 kHz, an affine transformation is carried out in order to gradually pass from the synthetic HRTFs to the selected HRTFs.

In 2001, the company Arkamys and the CNRS filed a patent (B. F. Katz and D. Schönstein, "Procédé de selection de filtres hrtf perceptivement optimale dans une base de données à partir de paramètres morphologiques" ["Method for selecting perceptually optimal HRTF filters in a database according to morphological parameters"] WO2011128583) relating to a morphology-based selection method. The idea was to build three databases, the first containing the HRTFs of a set of individuals, the second containing a set of morphological parameters of these individuals, and the third containing the listening preferences of these individuals i.e., for each subject, his classification of the HRTFs in the first database. Once these databases created, a study of the correlations between the second and third databases is carried out in order to sort the morphological parameters in order of importance. A dimensional analysis of the HRTF space (for example a PCA) is carried out in order to obtain a basis in which the HRTFs are representable. The relationships between the K most important morphological parameters and the coordinates of the HRTFs in the aforementioned space are then calculated, establishing a link between morphology and HRTFs. Given a new individual, carrying out the aforementioned measurement of the K morphological parameters then allows his position in the HRTF space to be determined. The nearest neighbor in database is sought and forms the result of the personalization.

The problem encountered in the preceding methods using morphological parameters is that of how to define the number and location of these parameters. Specifically, the notion, for example, of the height of an ear is not something that has a natural definition, and measurement thereof will be very dependent on measurer subjectivity as he will, first of all, have to determine whether the ear must be turned and where the "highest" and "lowest" points are located. Moreover, the question arises as to the criteria to use to define the distance used because it is on the latter that the result of the selection depends.

Lastly come adapted-selection methods, the most prominent example of which is doubtlessly frequency scaling, introduced by Middlebrooks (John C Middlebrooks, "Virtual localization improved by scaling nonindividualized external-ear transfer functions in frequency", The Journal of the Acoustical Society of America, 106(3), 1493-1510, 1999); this operation is based on the idea that the interaction of an audio source of given frequency with a solid depends on the dimensions of the latter. In particular, any homothetic transformation of an object must be accompanied, if it is still desired to observe the same interaction, by a homothetic transformation of inverse ratio in frequency. Applied to customization, this idea amounts to saying that, if the HRTFs of a reference individual (or even of a dummy head) and the scaling factor between the morphology of this reference and that of a subject for whom customization is required are known, it is possible to improve the localization sensation achieved with the reference HRTFs by applying thereto a scaling of inverse ratio.

In parallel to frequency scaling, Maki and Furukawa (Katuhiro Maki and Shigeto Furukawa; "Reducing individual differences in the external-ear transfer functions of the Mongolian gerbil; The Journal of the Acoustical Society of America, 118(4), 2005) have shown that, starting with the datum of the angle between a reference external-ear and a test external-ear, a rotation of the coordinate system giving the direction of the HRTFs allows inter-individual differences to be significantly decreased. In other words, this method takes advantage of the fact that a rotation of the external-ear of a subject induces an identical rotation in the measured HRTFs.

Although useful, these approaches nevertheless do not, considered in isolation, form complete personalization methods. Such methods must decrease HRTF variability to only 1 or 2 parameters. However, the above approaches may be seen as complementing other methods well.

Despite the many known approaches aiming to personalize binaural sounds, not one has yet clearly stood out from the rest in terms of its effectiveness and simplicity. In addition, each thereof may lead to problems such as prohibitive personalization times or unreliable solutions, or indeed both of these simultaneously.

SUMMARY OF THE INVENTION

One aim of the invention is to generate an individual-specific head-related transfer function (HRTF) more rapidly and with a higher reliability.

In the rest of the description, the expression "ear data", "ear space" or "ears" means 2D photographs of ears or 3D ears represented by a 3D point cloud describing the surface of the ear.

Thus, according to one aspect of the invention, a method is provided for generating an individual-specific head-related transfer function (HRTF) from a database containing 3D or 2D ear data and corresponding head-related transfer functions, the method comprising the steps of:

performing a statistical analysis of the 3D or 2D ear space of the database;

performing a statistical analysis of the head-related-transfer-function space of the database;

performing an analysis of the relationships between said statistical parameters of the 3D or 2D ear space and said statistical parameters of the head-related-transfer-function space; and determining, from said relationship analysis and said statistical analysis of the 3D or 2D ear space, a function for calculating a head-related transfer function from data representative of at least one ear.

Thus, since relationships between HRTFs and ear data are determined upstream, it is possible to use them in real-time applications. Moreover, the statistical character of the analyses allows simplifications introduced by physical models and the approximations that result therefrom to be avoided.

Of course, any given HRTF is associated with one spatial direction and, to recreate a complete virtual auditory environment, it is therefore necessary to provide HRTFs for a substantial number of directions, the present invention allowing this to be done for any number of desired directions.

According to one embodiment, the method furthermore comprises a step consisting in densely matching points relating to respective positions of the ears of the database.

In one embodiment, the method furthermore comprises a step of calculating an individual-specific head-related transfer function using said calculating function and at least one photograph of at least one ear of the individual.

Thus, use of the calculating function allows the transfer function to be determined in a time compatible with a real-time application.

According to one embodiment, said step of calculating a head-related transfer function is iterative.

In one embodiment, said iterative step of calculating a head-related transfer function comprises:

a first iterative substep of estimating at least one postural parameter of the individual in said at least one photograph; and a second iterative substep of estimating optimized statistical parameters representing at least one ear of the individual in the ear space.

Thus, it is possible to reconstruct an ear in 3D from a photograph that does not require the user to take any particular precautions when taking the photograph.

According to one embodiment, said ear-representing data are point clouds.

Thus, the visualization and study of properties, in particular geometric properties, of the data are facilitated.

In one embodiment, said disclosed steps are used to generate an individual-specific head-related transfer function for high frequencies above a threshold, said method furthermore comprising a step of generating an individual-specific head-related transfer function for low frequencies below said threshold.

Thus, each portion of the frequency spectrum is tailored to the physical structures that have the most impact thereon.

According to one embodiment, said step of generating an individual-specific head-related transfer function for low frequencies below said threshold comprises the following substeps of:

- sampling ranges of possible values of human morphological parameters from a database of data relating to human morphology;
- defining a mesh on the basis of a parametric model of said morphological parameters;
- calculating low-frequency template transfer functions associated with said mesh;
- estimating the value of morphological parameters of the individual from at least one face-on or profile photograph of the individual; and
- calculating an individual-specific head-related transfer function for low frequencies from the estimated value of the morphological parameters and said calculated low-frequency template transfer functions.

Thus, most of the calculations are carried out upstream, allowing the method to be used within real-time applications.

In one embodiment, a head-related transfer function of the individual is generated on the basis of said transfer functions for high and low frequencies, respectively, and of said at least one face-on or profile photograph of the individual, comprising the steps of:

estimating, from said at least one face-on or profile photograph of the individual, ear size relative to the rest of the body of the individual;

frequency scaling the head-related transfer functions, for the high frequencies; and fusing the transfer functions for high and low frequencies, respectively, in order to obtain the head-related transfer function of the individual.

For an individual, the photograph of a single ear may suffice, assuming the ears of the individual to be symmetric; however, as a variant, a higher precision is obtained with photographs of both ears of an individual.

According to another aspect of the invention, a system is also provided for generating an individual-specific head-related transfer function, or HRTF, from a database containing ear data and corresponding head-related transfer functions, comprising a processor configured to implement the method as claimed in one of the preceding claims.

BRIEF DESCRIPTION OF THE DRAWINGS

The invention will be better understood on studying a few embodiments that are described by way of completely nonlimiting example and illustrated in the appended drawings, in which FIGS. 1 to 4 schematically illustrate the method according to the invention.

DETAILED DESCRIPTION

Figure 1:
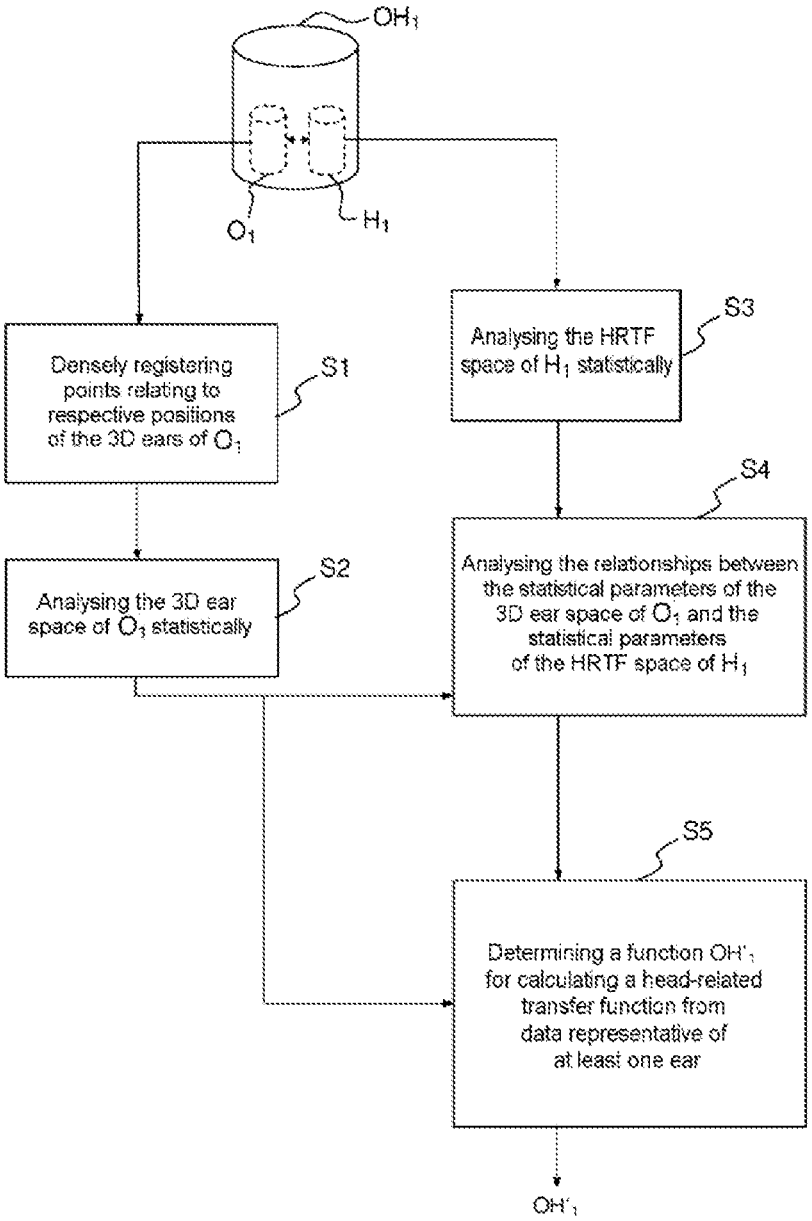

In FIG. 1, a database $OH_1$ contains ear data $O_1$ and corresponding head-related transfer functions $H_1$. By "corresponding" what is meant is the fact that, when this database is being built, for the individuals used to build the database, data representative of the ears of these individuals and their head-related transfer functions are recorded, the link between the ear data and the corresponding counter function of the database being preserved.

The ear data $O_1$ may be point clouds.

An optional step S1 allows points relating to respective positions of the is $O_1$ of the database $OH_1$ to be densely registered.

The expression "densely registered" is understood to mean the specification of correspondences between the constituent points of a cloud or the pixels of a 2D ear image and those constituents of another cloud or of another 2D ear image. By way of example, if the end of the ear lobe is represented by the point 2048 in one ear and by the point 157 in another, the specification of this role equivalence constitutes a registration. Cluster equivalence will possibly be spoken of, all the points of a given cluster playing a similar role within the ear to which they belong.

It is possible to use only one ear, the ears of a user being assumed to be symmetric.

A step S2 then allows the ear space $O_1$ of the database $OH_1$ to be analyzed statistically. This statistical analysis may be carried out, using a database of example ears, by technical means that reduce dimensionality (principal component analysis, independent component analysis, sparse coding, auto encoders, etc.). These techniques allow the representation of a 2D or 3D ear (taking the form of a point cloud or of pixels in an image) to be converted into a vector of statistical parameters of limited number.

A step S3 allows the head-related-transfer-function-space $H_1$ of the database $OH_1$ to be analyzed statistically. This statistical analysis is of the same type as that described in the preceding paragraph. It therefore allows the HRTFs to be represented by a vector of statistical parameters of limited number.

A step S4 allows relationships between said statistical parameters of the ear space of step S2 and said statistical parameters of the head-related-transfer-function space of step S3 to be analyzed.

Lastly, a step S5 allows, from said relationship analysis of step S4, and said statistical analysis of the ear space of step S2, a function $OH'_1$ to be determined for calculating a head-related transfer function $S_1$ from data representative of at least one ear.

The statistical analyses S2 and S3 must lead to the creation of parametric representations of the ears and of the head-related transfer functions. In particular, the learning data of the database $OH_1$ must be able to be reconstructed from the outputs of the analysis.

It is in particular possible to use, in the analyzing steps S2 and S3, principal component analysis (PCA).

By way of example, when PCA is selected to perform the dimensionality reduction, it consists in calculating, from a database of example data to be analyzed, the eigenvectors that best represent these data in the least-squares sense. The statistical parameters that represent the data to be analyzed (3D or 2D ear or head-related transfer function) are none other than the projection coefficients of this data projected onto the eigenvectors.

Alternatively, any type of linear or non-linear dimensional analysis will suffice, provided that it meets the aforementioned requirement with respect to reconstruction, examples of such methods being independent component analysis (ICA) or sparse coding.

The analysis of step S4 of the relationships between the sets of statistical parameters of the ear space and the statistical parameters of the head-related-transfer-function space, may be carried out, in a nominal configuration, by applying multivariate linear regression to the values of the parameters used for the reconstruction of the learning data of the database $OH_1$.

Alternatively, any method allowing the values of the set of parameters of the head-related transfer functions to be found from the values of the set of statistical parameters and ensuring a good reconstruction of the head-related transfer functions of the database $OH_1$ may be used, examples of such methods being methods based on neural networks, based on multiple component analysis (MCA) or based on k-means clustering.

Figure 2:
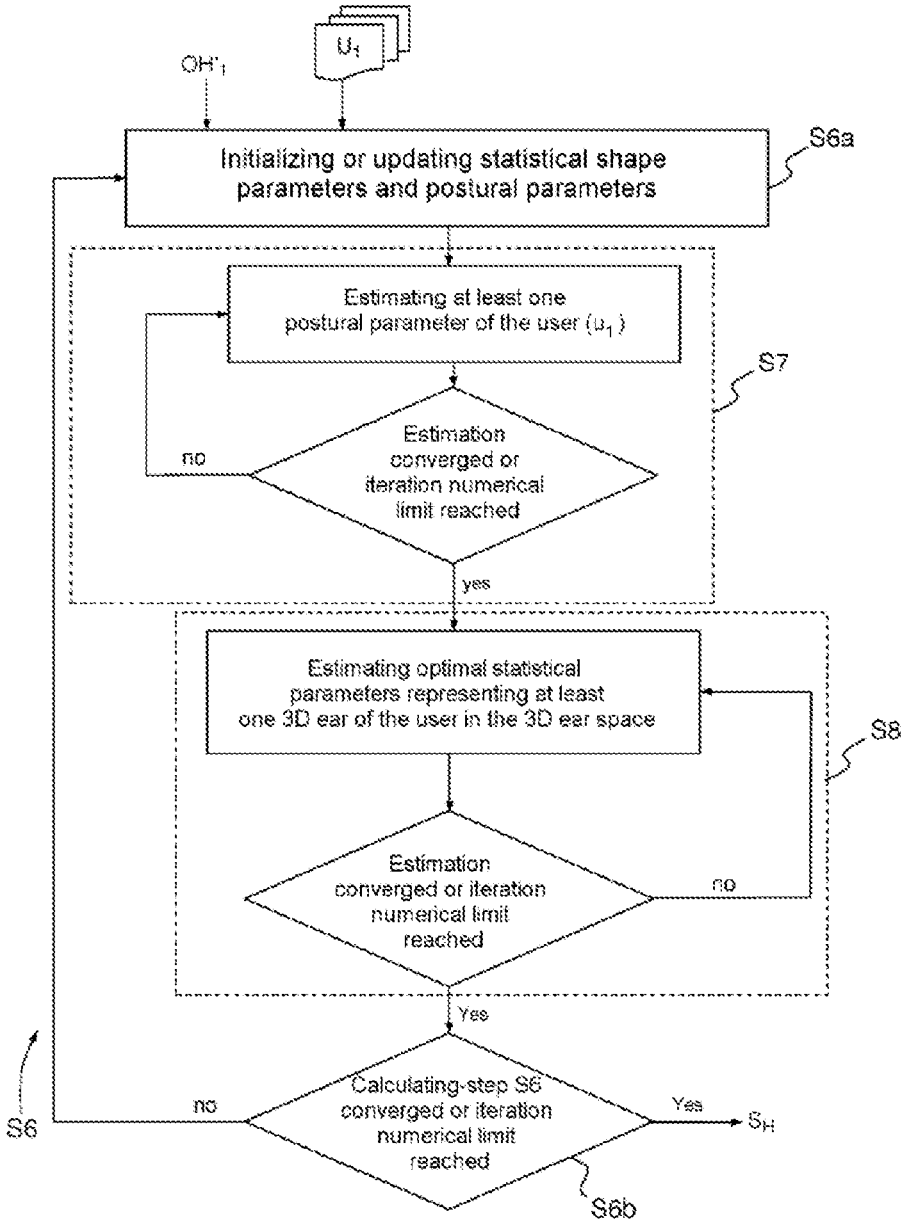

As illustrated in FIG. 2, the method may furthermore comprise a step S6 of calculating an individual-specific head-related transfer function $S_1$ using said calculating function $OH'_1$ and at least one photograph $U_1$ of an ear of the individual.

The step S6 of calculating a head-related transfer function $S_1$ may be iterative and comprise a first iterative substep S7 of estimating at least one postural parameter of the individual in said at least one photograph, and a second iterative substep S8 of estimating optimized statistical parameters representing at least one ear of the individual in the ear space.

Of course, the iterative step S6 of calculating a head-related transfer function $S_1$ then also comprises a substep S6*a* of initializing or updating statistical shape parameters and postural parameters, and a substep S6*b* of testing for convergence of the calculating step S6 or of checking whether a iteration numerical limit has been reached.

The first and second iterative substeps S7 and S8 of course each comprise a test of convergence of the respective estimation or a check of whether a iteration numerical limit has been reached.

The postural parameters of which it is question are reference to the angles at which the ears of the users are photographed.

The first and second iterative estimating substeps S7 and S8 employ active appearance models (AAM). In a nominal configuration, they are based on the use of regression matrices.

As a variant, it is possible to use any method allowing the 2D projection of the model to converge toward the 2D images of the users, examples of such methods being gradient-descent-based AAMs and simplex or genetic algorithms.

Figure 3:
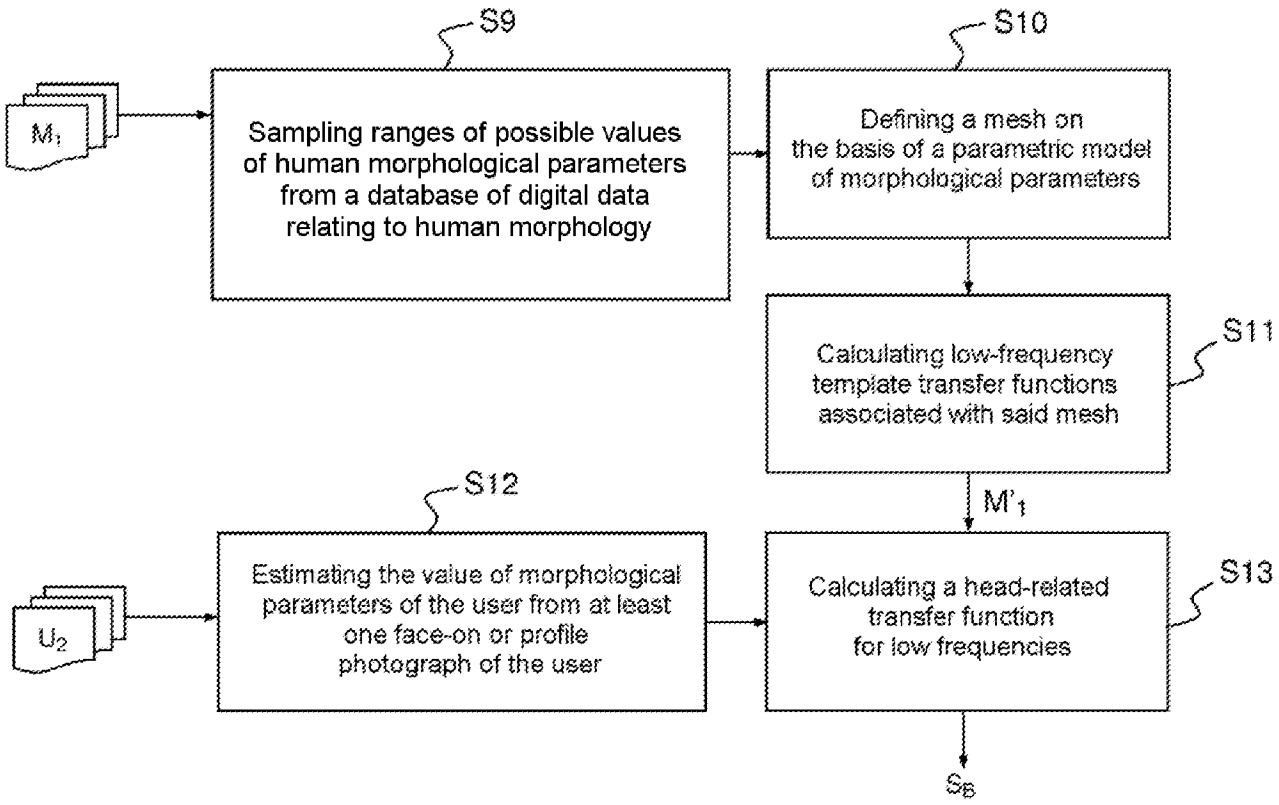

As illustrated in FIG. 3, said disclosed steps are used to generate an individual-specific head-related transfer function $S_H$ for high frequencies above a threshold, said method furthermore comprising a step of generating an individual-specific head-related transfer function $S_B$ for low frequencies below said threshold.

The step of generating an individual-specific head-related transfer function $S_B$ for low frequencies below said threshold comprises the following substeps of:

- sampling S9 ranges of possible values of human morphological parameters from a database $M_1$ of data relating to human morphology;
- defining S10 a mesh on the basis of a parametric model of said morphological parameters;
- calculating S11 low-frequency template transfer functions ($M'_1$), associated with said mesh;
- estimating S12 the value of morphological parameters of the individual from at least one face-on or profile photograph $U_2$ of the individual; and
- calculating S13 an individual-specific head-related transfer function $S_B$ for low frequencies from the estimated value of the morphological parameters and said calculated low-frequency template transfer functions.

The low-frequency template transfer functions $M'_1$, are calculated off-line and serve as a reference database of low-frequency (frequencies below a threshold, for example 2 kHz) head-related transfer functions.

For example, it is possible to use a snowball model. As a variant, any parametric model with few inputs and allowing a mesh of the head and torso to be obtained will suffice, an example of such a model being modelling of the head and torso with ellipsoids of revolution.

For example, macroscopic parameters may be the width of the shoulders and the diameter of the head. The choice of parameters is dictated by the choice of the model used for the calculation of the templates.

Figure 4:
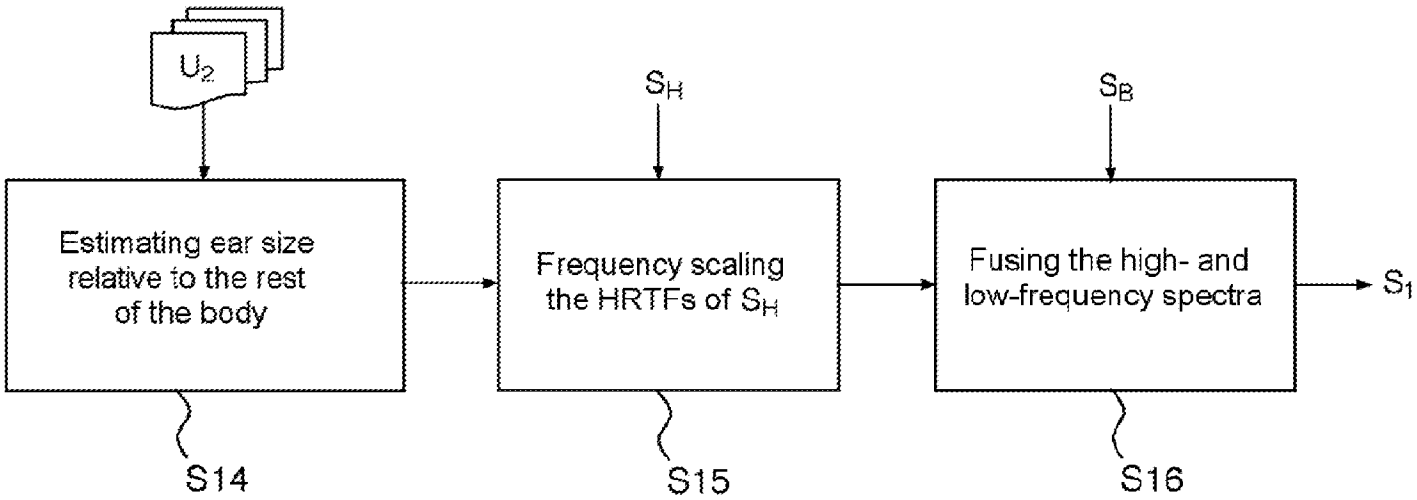

As illustrated in FIG. 4, a head-related transfer function $S_1$ of the individual is generated on the basis of said transfer functions $S_H$, $S_B$ for high and low frequencies, respectively, and of said at least one face-on or profile photograph $U_2$ of the individual, comprising the steps of:

estimating S14, from said at least one face-on or profile photograph $U_2$ of the individual, the ear size of the individual;

using said estimated ear size of the individual to adjust S15 the head-related transfer functions $S_H$ to the most suitable frequency band using the frequency scaling method, for the high frequencies; and fusing S16 the transfer functions $S_H$, $S_B$ for high and low frequencies, respectively, in order to obtain the head-related transfer function $S_1$ of the individual.

The dimensions of the ear may be standardized, in which case it is necessary to make provision to rescale the frequency spectrum generated for the ear.

Specifically, two ears that are identical to within a scaling factor have HRTFs that are identical to within the inverse of the same scaling factor. This is very important when a standardized model ear is used and there is no information, at the very least on initiation of the algorithm, on the actual dimensions of the ear of the subject. Therefore, if the reconstructed model of an ear is of 5 cm height when the ear of the subject is of 10 cm height, it will be necessary to compress the HRTFs by a factor of 0.5.

As a variant, if the ears are not subject to size standardization, the scaling step 15 becomes pointless.

The two portions of the spectrum are fused by summation thereof after application of a high-pass filter and a low-pass filter to the high-frequency spectrum and low-frequency spectrum, respectively The steps of the method described above may be carried out by one or more programmable processors executing a computer program in order to execute the functions of the invention by operating on input data and to generate output data.

A computer program may be written in any form of programming language, including compiled or interpreted languages, and the computer program may be deployed in any form, including as a standalone program or as a subprogram, element or other unit suitable for use in a computer environment. A computer program may be deployed so as to be executed on a computer or on multiple computers on one site or distributed across multiple sites and connected to one another by a communication network.

The preferred embodiment of the invention has been described. Various modifications may be made without departing from the spirit and the scope of the invention. Hence, other embodiments fall within the scope of the following claims.

The invention claimed is:

1. A non-transitory computer readable storage medium storing instructions which when executed on a processor, causes the processor to perform actions comprising:

performing a statistical analysis leading to a reduction in a dimensionality of the 3D or 2D ear space of the database, and representing each 3D or 2D ear by a vector of first statistical parameters, wherein values of the components of each vector are values obtained by projecting each ear into an ear space of reduced dimensionality;

performing a statistical analysis leading to a reduction in the dimensionality of a head-related-transfer-function space of the database, and representing each transfer function by a vector of second statistical parameters, wherein values of the components of each vector are values obtained by projecting each transfer function into the transfer-function space of reduced dimensionality;

performing an analysis of relationships between the first statistical parameters of the 3D or 2D ear space and the second statistical parameters of the head-related-transfer-function space;

determining, from said relationship analysis and said statistical analysis of the 3D or 2D ear space, a function for calculating a head-related transfer function from data representative of at least one ear;

based at least in part on the determined function for calculating a head-related transfer function, generating an individual-specific head-related transfer function for high frequencies above a threshold; and generating an individual-specific head-related transfer function for low frequencies below the threshold by:

sampling ranges of possible values of human morphological parameters from a database containing data relating to human morphology;

defining a mesh based at least in part on a parametric model of the sampled possible values of the human morphological parameters;

calculating low-frequency template transfer functions associated with the mesh;

estimating the value of human morphological parameters of the individual, the estimating based on at least one face-on or profile photograph of the individual; and calculating the individual-specific head-related transfer function for low frequencies based on at least the estimated value of the human morphological parameters of the individual and the calculated low-frequency template transfer functions associated with the mesh.

2. The non-transitory computer readable storage medium of claim 1, wherein the instructions further cause the processor to perform actions comprising densely matching points relating to respective positions of the ears of the database.

3. The non-transitory computer readable storage medium of claim 1, wherein the instructions further cause the processor to perform actions comprising calculating an individual-specific head-related transfer function using said calculating function and at least one photograph of at least one ear of the individual.

4. The non-transitory computer readable storage medium of claim 3, wherein calculating a head-related transfer function is an iterative step.

5. The non-transitory computer readable storage medium of claim 4, wherein calculating a head-related transfer function comprises:

a first iterative substep of estimating at least one postural parameter of the individual in said at least one photograph; and a second iterative substep of estimating optimized statistical parameters representing at least one ear of the individual in the ear space.

6. The non-transitory computer readable storage medium of claim 1, wherein the data representative of at least one ear comprises one or more point clouds.

7. The non-transitory computer readable storage medium of claim 1, wherein the instructions further cause the processor to perform actions comprising:

estimating, from the at least one face-on or profile photograph of the individual, a relative ear size, where the relative ear size is estimated relative to a body size of the individual;

frequency scaling the individual-specific head-related transfer function for high frequencies; and fusing the individual-specific transfer function for low frequencies and the frequency scaled individual-specific head-related transfer function for high frequencies in order to thereby obtain the head-related transfer function of the individual.

8. An audio processing system for generating an individual-specific head-related transfer function, the system comprising:

a database containing ear data and corresponding head-related transfer functions;

a processor; and a memory storing instructions which when executed by the processor causes the processor to perform actions comprising:

performing a statistical analysis leading to a reduction in a dimensionality of the 3D or 2D ear space of the database, and representing each 3D or 2D ear by a vector of first statistical parameters, wherein values of the components of each vector are values obtained by projecting each ear into an ear space of reduced dimensionality;

performing a statistical analysis leading to a reduction in the dimensionality of a head-related-transfer-function space of the database, and representing each transfer function by a vector of second statistical parameters, wherein values of the components of each vector are values obtained by projecting each transfer function into the transfer-function space of reduced dimensionality;

performing an analysis of relationships between the first statistical parameters of the 3D or 2D ear space and the second statistical parameters of the head-related-transfer-function space;

determining, from said relationship analysis and said statistical analysis of the 3D or 2D ear space, a function for calculating a head-related transfer function from data representative of at least one ear;

based at least in part on the determined function for calculating a head-related transfer function, generating an individual-specific head-related transfer function for high frequencies above a threshold; and generating an individual-specific head-related transfer function for low frequencies below the threshold by:

sampling ranges of possible values of human morphological parameters from a database containing data relating to human morphology;

defining a mesh based at least in part on a parametric model of the sampled possible values of the human morphological parameters;

calculating low-frequency template transfer functions for the mesh;

estimating the value of human morphological parameters of the individual, the estimating based on at least one face-on or profile photograph of the individual; and calculating the individual-specific head-related transfer function for low frequencies based on at least the estimated value of the human morphological parameters of the individual and the calculated low-frequency template transfer functions associated with the mesh.

9. A method comprising:

performing a statistical analysis leading to a reduction in a dimensionality of the 3D or 2D ear space of the database, and representing each 3D or 2D ear by a vector of first statistical parameters, wherein values of the components of each vector are values obtained by projecting each ear into an ear space of reduced dimensionality;

performing a statistical analysis leading to a reduction in the dimensionality of a head-related-transfer-function space of the database, and representing each transfer function by a vector of second statistical parameters, wherein values of the components of each vector are values obtained by projecting each transfer function into the transfer-function space of reduced dimensionality;

performing an analysis of relationships between the first statistical parameters of the 3D or 2D ear space and the second statistical parameters of the head-related-transfer-function space;

determining, from said relationship analysis and said statistical analysis of the 3D or 2D ear space, a function for calculating a head-related transfer function from data representative of at least one ear;

based at least in part on the determined function for calculating a head-related transfer function, generating an individual-specific head-related transfer function for high frequencies above a threshold; and generating an individual-specific head-related transfer function for low frequencies below the threshold by:

sampling ranges of possible values of human morphological parameters from a database containing data relating to human morphology;

defining a mesh based at least in part on a parametric model of the sampled possible values of the human morphological parameters;

calculating low-frequency template transfer functions for the mesh;

estimating the value of human morphological parameters of the individual, the estimating based on at least one face-on or profile photograph of the individual; and calculating the individual-specific head-related transfer function for low frequencies based on at least the estimated value of the human morphological parameters of the individual and the calculated low-frequency template transfer functions associated with the mesh.

* * * * *